United States Patent [19]

Thevenot et al.

[11] 4,404,045

[45] Sep. 13, 1983

[54] SURFACE-BORONIZED PIECES

[75] Inventors: Francois H. J. Thevenot, Saint-Etienne; Patrice M. V. Goeuriot, Firminy; Julian H. Driver, Saint-Etienne; Jean-Paul R. Lebrun, Bougival, all of France

[73] Assignee: Association pour la Recherche et le Development des Methodes et Processus Industriels (Armines), Paris, France

[21] Appl. No.: 261,940

[22] Filed: May 8, 1981

Related U.S. Application Data

[62] Division of Ser. No. 123,425, Feb. 21, 1980, Pat. No. 4,289,545.

[30] Foreign Application Priority Data

Feb. 27, 1979 [FR] France ..... 79 04991

[51] Int. Cl.[3] ..... C23C 9/00

[52] U.S. Cl. ..... 148/31.5; 428/215; 428/469

[58] Field of Search ..... 148/31.5; 428/469, 627, 428/215, 216

[56] References Cited

U.S. PATENT DOCUMENTS

| | | | |
|---|---|---|---|
| 2,801,187 | 7/1957 | Galmiche | 427/252 |
| 2,816,048 | 12/1957 | Galmiche | 427/253 |
| 3,622,402 | 11/1971 | Baranow et al. | 148/31.5 |
| 3,673,005 | 6/1972 | Kunst | 148/6.35 |
| 3,806,374 | 4/1974 | Krzyminski | 148/31.5 |
| 3,936,327 | 2/1976 | Fichtl et al. | 148/27 |
| 4,188,242 | 2/1980 | Scales | 148/31.5 |

FOREIGN PATENT DOCUMENTS

| | | | |
|---|---|---|---|
| 47-14481 | 1/1972 | Japan | 148/31.5 |
| 581168 | 12/1972 | U.S.S.R. | 148/31.5 |
| 722965 | 3/1980 | U.S.S.R. | 148/31.5 |

OTHER PUBLICATIONS

Zhunkovskii, G. L., et al., "Boronizing of Cobalt and Some Cobalt Base Alloys"; Translated From *Poroshkovaya Metallurgiya,* vol. 119, pp. 33–35, (1972).

Knotek, O., et al.; "Surface Layers on Cobalt Base Alloys by Boron Diffusion", *Thin Solid Films,* vol. 45, pp. 331–339, (1977).

Fichtl, W.; "Boronizing and its Practical Applications"; *Rev. Int. Hautes Temper* Retract., Fr.; vol. 17 pp. 33–35, (1980).

Von Matuschka, A. Graf,; *Borieren,* Carl Hanser Verlag, München Wien, pp. 1–19.

*Primary Examiner*—Michael L. Lewis

*Attorney, Agent, or Firm*—Cushman, Darby & Cushman

[57] ABSTRACT

The invention relates to a process and apparatus for boronizing pieces made of metal or cermet and to surface-boronized pieces. The pieces are placed in a chamber at between 850° and 1,150° C. and they are subjected, in the presence of boron carbide, to a gaseous stream of trifluoroboroxole $(BOF)_3$. The boron carbide is advantageously pulverulent and out of contact with the pieces to be boronized.

3 Claims, 11 Drawing Figures

SURFACE-BORONIZED PIECES

CROSS REFERENCE TO RELATED APPLICATION

This application is a division of my earlier co-pending application, Ser. No. 123,425, filed Feb. 21, 1980, now U.S. Pat. No. 4,289,545.

BACKGROUND OF THE INVENTION

1. Field of the Invention

The invention relates to a process and apparatus for boronising pieces made of metal or cermet and to surface-boronised pieces.

2. Description of the Prior Art

A process is known for the treatment of pieces made of a material from the group comprising alloys of metals of the iron family (Fe, Ni and Co) and cermets, in which process the pieces are heated to an operating temperature of the order of 850° to 1,150° C., in the presence of a solid boronising agent and the boronising is activated by simultaneously subjecting the pieces to the contact action of a stream of a gaseous fluorine-containing agent, under defined operating conditions regarding pressure and temperature.

A process of the type referred to above for the boronising of steels is known from French Patent No. 2,018,609 and the equivalent U.S. Pat. No. 3,673,005, in which process the activator is a fluoroborate which is mixed with the boronising agent, in the presence of borax and to which a diluent consisting of alumina is optionally added. The whole reaction takes place in the solid phase and makes it possible to obtain a coating in which two phases are observed, one phase being FeB and the other being $Fe_2B$. However, the different crystal structures of these two phases create tensile stresses, on cooling, which detract from the high strength of the coating, all the more so because the FeB phase is more fragile and this leads to risks that the coating will flake off. Furthermore, it is observed that the pieces boronised by this known process retain traces of adhered powder because of the appearance of a molten phase, whereupon they must be subjected to an additional treatment in order to remove the more or less fritted powder which adheres to their surface to a greater or lesser extent.

Moreover, since the activating agent, which is consumed, is present in the treatment bed, it must be replenished, for example, a quarter at a time, with fresh powder after each treatment operation.

Furthermore, it is known that the same process can be applied, with the same advantages and disadvantages, to cermets, in particular to tungsten carbide or titanium carbide, enclosed in a cobalt matrix. Reference can be made, for example, to the article by G. L. Zhunkovskii et al, Boronising of cobalt and some cobalt-base alloys—Soviet Powder Metallurgy, 11 (1972) pp. 888–90 and to the article by O. Knotek, et al, Surface layers on cobalt base alloys by boron diffusion—Thin Solid Films, 45 (1977) pp. 331–9.

SUMMARY OF THE INVENTION

The object of the invention is to provide a new, very economical process and a new apparatus which make it possible to avoid the abovementioned disadvantages, in particular by obtaining a monophase layer so far as carbon steels are concerned and by obtaining clean pieces without adhesion of powder in all cases.

These objects are achieved, according to the invention, in a process of the type described above, by virtue of the fact that the gaseous fluorine-containing agent contains trifluoroboroxole $(BOF)_3$. This activating agent exhibits numerous advantages which will become apparent below.

According to the invention, it is advantageous to use boron trifluoride ($BF_3$) or a gaseous mixture containing $BF_3$ as the starting gas and, in accordance with a preferred embodiment, the gaseous fluorine-containing agent containing trifluoroboroxole is produced by passing the starting gas through a pulverulent mass of mineral oxides free of cationic impurities, such as simple or complex oxides of silicon, aluminum and magnesium, for example a silican sand, the mass being heated to a temperature of at least 450° C.

In this way, there are no longer any disadvantages caused by the internal consumption of the activating agent, because the latter is supplied externally. Also in this way, and depending on the speed at which the fluorine-containing activating agent passes through the pulverulent mass of oxides, a moderation is observed in the action of the effluent gaseous agent from the said mass. If the agent introduced into the mass heated to at least 450° C. is boron trifluoride, as is most economic according to the invention, the effluent will contain trifluoroboroxole, according to the equation:

$$BF_3+3MO\rightarrow(BOF)_3+3MF$$

in which MO is the simple or complex oxide.

In all cases, it is much simpler according to the invention to separate the boronising agent, very little of which is consumed, a moderator, of which again very little is consumed and the activating agent.

It is advantageous to bring the fluorine-containing activating agent into contact with the pieces to be boronised at an adjustable flow-rate and preferably at a pressure of the order of atmospheric pressure.

According to an embodiment, the fluorine-containing agent is diluted to an inert carrier gas.

According to an embodiment, the boronising agent can be not only $B_4C$ but also any boron carbide $B_nC$, in which n is between 4 and 10. Also, according to an advantageous characteristic of the invention, it is possible to choose whether to increase or reduce the proportion of $B^{10}$ in the boron of the solid boronising agent and/or of the gaseous, fluorine-containing activating agent or starting gas. In this way, it is possible to obtain pieces having a larger or smaller, controlled neutron-stopping cross-section, by increasing the proportion of $B^{10}$, which has a large cross-section, or by increasing the proportion of $B^{11}$, which is very transparent to neutrons.

According to a preferred embodiment of the invention, the solid boronising agent and the pieces to be boronised are subjected to the contact action of the stream of gaseous fluorine-containing agent, whilst being out of mutual contact. This embodiment is decisive in making it possible to obtain clean pieces free of more or less fritted powder. This embodiment is therefore carried out in the gas phase, as will be explained below, which results in economy and ease of working.

For this purpose, the solid boronising agent present with the pieces to be boronised is advantageously placed in the stream of the gaseous fluorine-containing agent, upstream of the pieces to be boronised. Using this embodiment, the pieces to be boronised can be arranged directly in a treatment chamber in order to expose them, in the chamber, only to the gaseous treatment phase. However, in the case of very small pieces, they can be arranged in a bed consisting of a granular or pulverulent inert mass such as silicon carbide.

Although, according to the preferred embodiment, the solid boronising agent and the pieces to be boronised are out of mutual contact, it is nevertheless possible for the solid boronising agent to be arranged in the form of a pulverulent solid constituting the treatment bed for the pieces to be boronised, in a manner which is in itself known.

It is advantageous to recycle at least part of the gaseous, fluorine-containing activating agent.

A particularly suitable apparatus for putting the invention into effect comprises: a first boronising treatment chamber, means for heating the said first chamber to a temperature of the order of 850° to 1,150° C., a second chamber for a pulverulent or granular mass of mineral oxides, means for heating the said second chamber to at least about 450° C., means for bringing a flourine-containing gas into the said second chamber, a passage for transferring the gaseous fluorine-containing effluent from the second chamber to the first chamber and means for discharging the gaseous fluorine-containing effluent from the said first chamber.

The invention also relates to pieces of carbon steel which have been subjected, on the surface, to a boronising treatment over a thickness of about 20 to 200 μm, the said pieces being covered with a monophase layer of crystals of $Fe_2B$ of acicular formation. The micrographs included as drawings, and which will be subsequently described, show the acicular formation or morphology as the term is referred to in this specification. For example, FIGS. 5 and 6 show needle-like or tooth-like or finger-like projections extending downward from an $Fe_2B$ layer into the steel portion at the $Fe_2B$-steel interface of a boronised steel object.

DETAILED DESCRIPTION OF THE INVENTION

Figure 1:
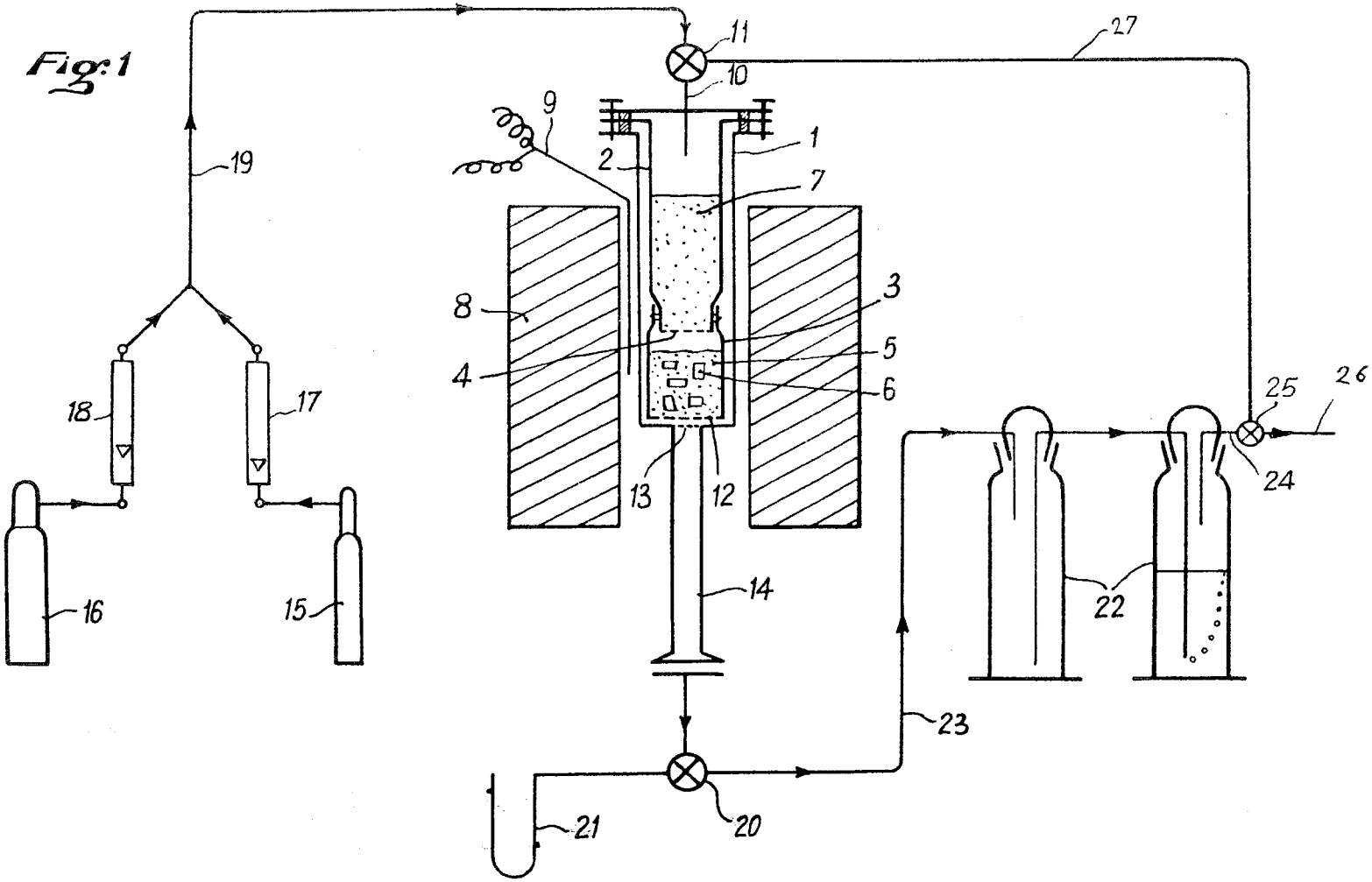
FIG. 1 is a general plan of an installation, according to the invention, for carrying out the process according to the invention.

An installation according to the invention comprises a reactor 1 made of refractory steel. Viewing from top to bottom, two chambers 2 and 3, which are separated simply by a retaining grid 4 located at the bottom of the chamber 2, are arranged in this reactor. The lower chamber 3 is intended to contain the pieces 6 to be boronised. The upper chamber 2 is intended to contain a pulverulent mass of mineral oxides 7. The reactor 1 is in a furnace 8, the temperature of which is regulated, in a manner which is in itself known, by means of a thermocouple 9.

A pipe 10, controlled by a valve 11, is inserted through the upper wall of the reactor 1 so as to emerge in the chamber 2. The chamber 3 and the reactor 1 are closed, at the bottom, by means of porous walls, respectively 12 and 13, the porous wall 13 being closed, on its other face, by a pipe 14 for discharging the gaseous effluents.

The valve 11 is connected, for the gas feed, to two sources of gas, respectively a source 15 of compressed boron trifluoride and a source 16 of inert diluent gas, such as argon or nitrogen. These two sources 15 and 16 are connected to the valve 11 via two flowmeters 17 and 18, which lead into a common pipe 19.

The pipe 14 itself leads to a valve 20 which is connected to a manometer 21 and to a scrubbing unit 22 via a pipe 23. At the outlet of the pipe 24, it is possible to add a dividing valve 25, between a discharge pipe 26 and a recycling pipe 27, the said valve bringing part of the gaseous effluent back to the valve 11, which is then a mixer valve.

In the embodiment of FIG. 1, provision has been made for the lower chamber 3 to contain the boronising agent 5 in the form of a bed surrounding the pieces, in a manner which is in itself known. However, according to the embodiment of FIG. 2, the lower chamber 3 does not contain a pulverulent or granular bed. In this case, the pieces 6 and the solid boronising agent are separated from one another and the agent is arranged in the form of fritted elements 30, suspended in the lower chamber 3.

Figure 3:
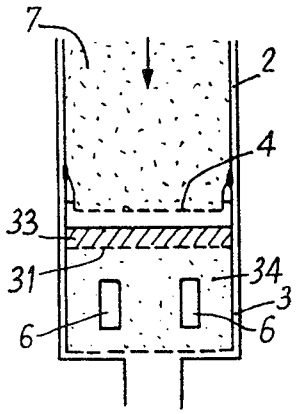
Figure 4:
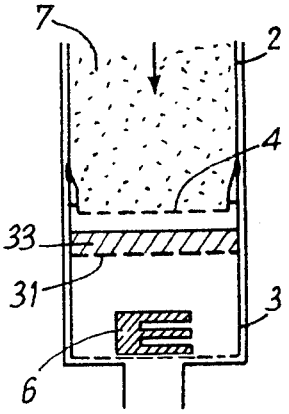

However, according to the invention, the preferred embodiment is that of FIGS. 3 and 4, which differs from the preceding embodiment by a presence of a retaining grid 31, arranged in the upper part of the lower chamber 3, for an interposed bed of pulverulent, solid boronising agent 33 of particle size 1 to 2 μm, in the path of the gaseous activating agent brought through the pulverulent mass of mineral oxides 7. The embodiment of FIG. 3 is suitable for small pieces which can be surrounded by pulverulent silicon carbide 34 as the inert agent. In FIG. 4, the bed of silicon carbide has simply been omitted so that the piece or pieces 6 is or are placed directly in the chamber 3.

In the installation of FIG. 1, a boronising agent of a known type has been arranged in the chamber 3, the agent consisting of powdered $B_4C$ of particle size 1 to 100 μm, which is mixed with powdered silicon carbide of particle size 100 μm, in a proportion of 2/98 to 100/0 by weight. A pure silica sand washed with acids, 90% of which passes through a 2 mm screen, has been placed in the chamber 2. After pieces to be treated have been placed in the bed of the chamber 3, the chamber is swept with an inert gas, namely nitrogen or argon and the temperature is simultaneously raised. The $BF_3$ gas, diluted if appropriate, is then passed through when the temperature reaches about 500° to 950° C. The latter is chosen as the boronising temperature. The duration of the passage of the activating gas varies from half to the whole of the residence time of the pieces at 950° C., the said residence time being about 5 hours. Simultaneously, the temperature of the bed of silica 7 is raised to about 850° C.

EXAMPLES 1 and 2

Two steels, containing 0.1% and 0.35% of carbon, were tested with a weight proportion $B_4C$/SIC of 20/80, these steels being respectively designated XC 10 and XC 35 in accordance with the AFNOR designation. After cooling, the pieces were examined in the laboratory.

It was found (see the micrograph sections in FIGS. 5 and 6) that, in both cases, the pieces were covered with a 170 μm monophase layer A of oriented $Fe_2B$ crystals, with the formation of teeth penetrating deeply into the metal C to constitute an acicular formation therein. A layer B, of only 10 μm, of non-oriented $FeB/Fe_2B$ crystals covered the $Fe_2B$ layer and was not therefore likely to cause harmful tensile stresses therein, because, as in the known processes, this layer can be removed by simply sanding with a jet or can even be preserved as such, since it is removed in use, if pieces having a matt appearance are acceptable.

Thus, useful 170 μm layers were obtained which were virtually monophase, whereas, using the known process. all other things being equal, 200 μm layers were obtained which, however, were two-phase with two layers of highly oriented, different phases of FeB and $Fe_2B$ in a proportion of $\frac{1}{2}$ to $\frac{1}{3}$.

Figure 2:
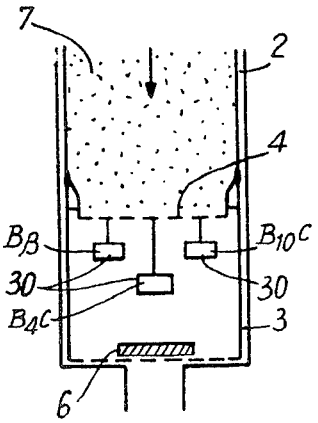
FIGS. 2, 3 and 4 are partial sections, on a larger scale, of that part of the reactor of FIG. 1 which contains the two chambers described below.

The process was then carried out, in accordance with the preferred embodiment of the invention, with the installation of FIG. 1 being modified as shown in FIGS. 2, 3 and 4.

EXAMPLE 3

Figure 7:
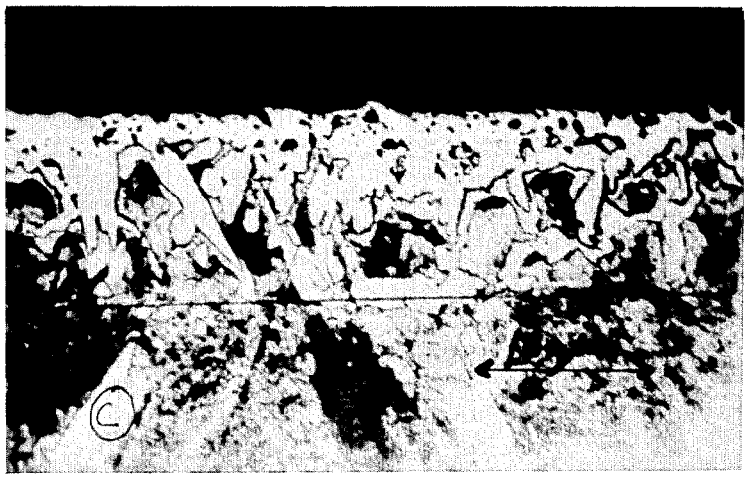

In the embodiment of FIG. 2, a piece 6 made of carbon steel was placed in the presence of, but out of contact with, pieces 30 fritted under the action of heat, which were made of β boron, $B_4C$ and $B_{10}C$. $BF_3$ was passed through the bed of sand 7 in the chamber 2 for 18 hours, the temperature of the chamber 3 being kept at 1,000° C. FIG. 7 shows a micrograph section of the steel boronised in this way.

EXAMPLE 4

Figure 8:
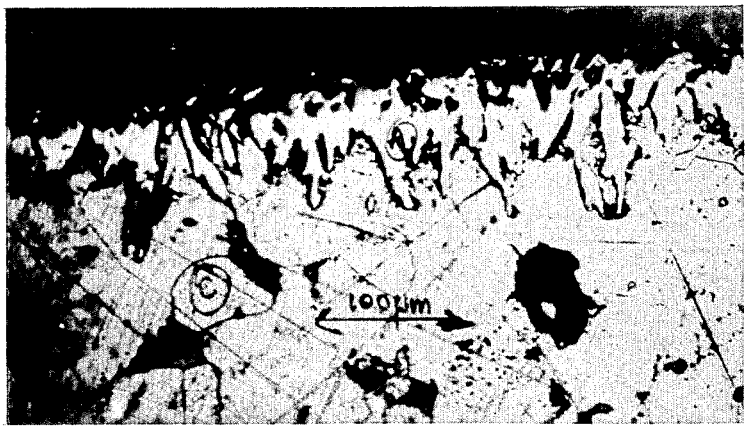
Figure 9:
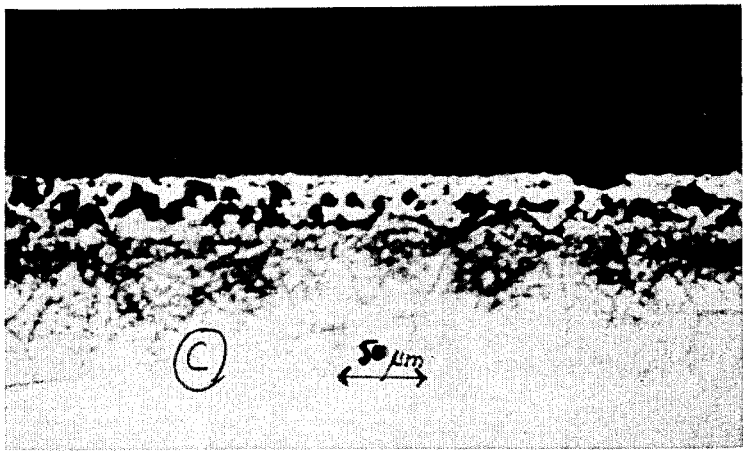

In the embodiment of FIG. 3, two pieces, one being made of carbon steel and the other of 18/10 chrome/-nickel steel, were placed in the bed 34 of SiC in the chamber 3. $BF_3$ was passed through the bed of sand 7 in the chamber 2 for 2.5 hours, the temperature of the chamber 3 being kept at 1,020° C. FIG. 8 shows a micrograph section of the carbon steel boronised in this way and FIG. 9 shows a section of the chrome/nickel steel boronised in this way.

EXAMPLES 5 and 6

Figure 10:
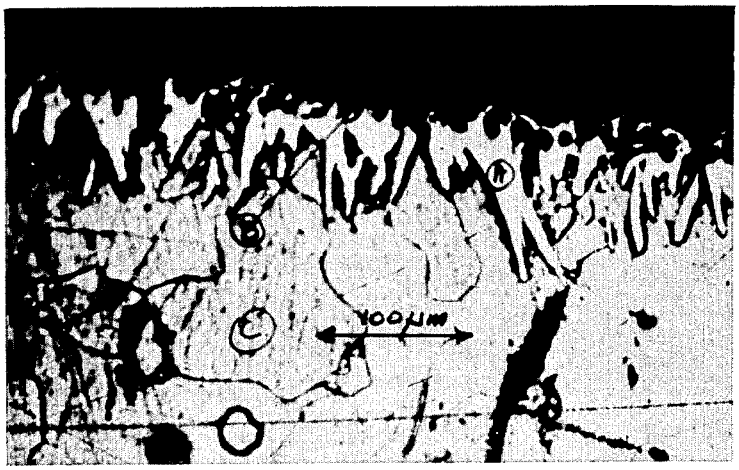
Figure 11:
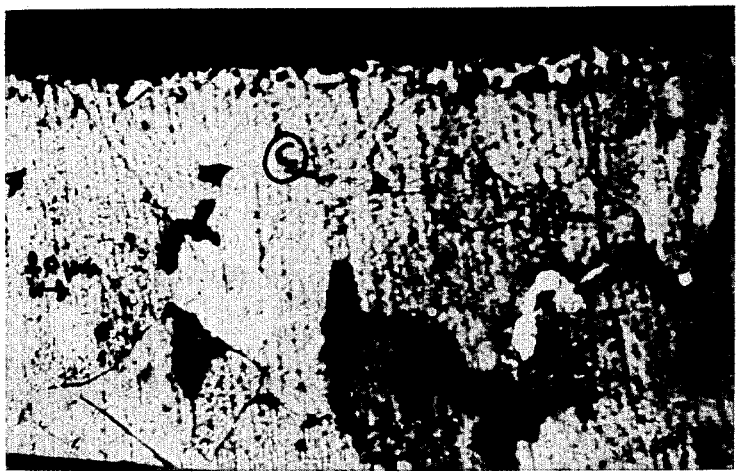

In the embodiment of FIG. 4, a piece 6 made of carbon steel, which had received two 0.5 mm saw cuts in its side, was treated. $BF_3$ was passed through the bed of sand 7 in the chamber 2 for 2 hours at 1,000° C. FIG. 10 shows a micrograph section of the external surface of the piece, and FIG. 11 shows a micrograph section on the surface of the saw notch.

Each of these operations resulted in the boronising of the steel pieces present in the reactor. The thickness of the compact layer ($Fe_2B$ alone) is fairly low in the case of the process of Example 3, namely about 15 to 20 μm. A metallographic study of the pieces treated in this way provides information on the morphology of these layers. In the case of the process of Example 4, they are identical to those already observed in Examples 1 and 2. The layer is not strictly flat (FIG. 9) and it is noted that the boronising stops at certain grain boundaries when the latter are parallel to the surface or form an angle with the latter which ranges up to about 120°. FIG. 7 shows the appearance of the boronised layer obtained in the case of the reactor of Example 3. The progression of the dendrites does not take place perpendicular to the surface but has been disturbed by the presence of a phase which has the appearance of perlite after cooling. The boronising rate thus has a significant influence on the progression of the boronised layer in the matrix and the direction of growth (001) is not absolute.

As regards the piece which has received saw cuts, it is found that this piece is boronised (FIGS. 10 and 11) not only on the two external faces (90 to 120 μm) but also on the internal faces defined by the saw cuts. A micrograph of these internal faces shows a boronised layer of variable thickness and of discontinuous acicular character, which is explained by the intervention of a gas phase alone.

The conclusion drawn from these tests is that, since boronising in the gas phase is perfectly satisfactory, it becomes industrially possible, in the reactor, to separate the chamber for the generator of the gaseous boron-containing agents ($BF_3+SiO_2$, $B_4C$) from the metal pieces to be boronised, which can conveniently be placed in a bed of SiC or, alternatively, if desired, can be left bare.

It is seen that the invention has made it possible to develop an original process which makes it possible to boronise all steels, including tool steels, with total reliability. The processes of the prior art resulted in pieces of mediocre quality when using mild steels (formation of two layers $FeB+Fe_2B$); the flexibility of the process of the invention, coupled with the use of an activation moderator ($SiO_2$), makes it possible, also under industrial conditions, to produce pieces of desired and satisfactory quality. Mechanical tests have shown that the strength of the layers obtained on tool steel is of a very high calibre. As in the case of the known processes, the boronising of stainless 18/10 chrome/nickel steel still has only a slight effect.

Moreover, from a purely industrial point of view, the advantages of the process are considerable, namely simplicity, flexibility, labour saving (lack of adhesion of the powder to the pieces) and total reliability according to numerous tests carried out to scale. The cost price of the operation is reduced by a factor of about three as regards the consumable materials and the handling operations are reduced to a minimum.

The above operating conditions are the preferred conditions, but it was possible to obtain viable results with $Al_2O_3$ and MgO, it being noted, however, that these two oxides lead to a fairly high activity of the effluent used as the gaseous activating agent, which then contains boric anhydride $B_2O_3$. $SiO_2$ is ultimately the most favourable in the role of a moderator and it is therefore preferred.

The times, percentages and particle sizes given in the above description do not imply a limitation. They can be varied in accordance with the desired, higher or lower rate of formation of the layer and in accordance with the thickness of the layer. Some of these factors only have a small influence, such as, for example, the particle size of $B_4C$ and SiC.

The Applicants have also observed good results with boron carbides other than $B_4C$, such as the borides $B_nC$, in which n is between 4 and 10.

It is within the scope of the invention to feed several boronising chambers 3 with activating gas from a single chamber 2.

As regards the application of the invention to cermets, tests were carried out on tungsten carbide tools containing varying proportions of cobalt (or nickel or iron) using the installation of FIG. 1. Boronised pieces are obtained using a flow-rate of $BF_3$ of 1 to 5 liters/- hour and setting the treatment temperature at between 800° and 1,100° C.

At 950° C., the main phase detected by X-ray diffraction is CoB; the mixed boride $W_2CoB_2$ also appears to be present; on the other hand, $W_2B_5$ is absent. Depending on the temperature, various mixed borides (W-Co) can be formed.

Machining tests were carried out by traversing various materials (non-graphitised carbon, stainless 18/10 nickel/chrome steel, high-speed steel, ceramics and the like) on a lathe. It was observed that the boronised tool showed a very superior wear resistance to that of the untreated tool and that the test on high-speed steel showed that the boronised or non-boronised tools deteriorated fairly rapidly; however, the cut obtained with the boronised tool is clean (non-boronised plates do not permit cutting).

Figure 12:
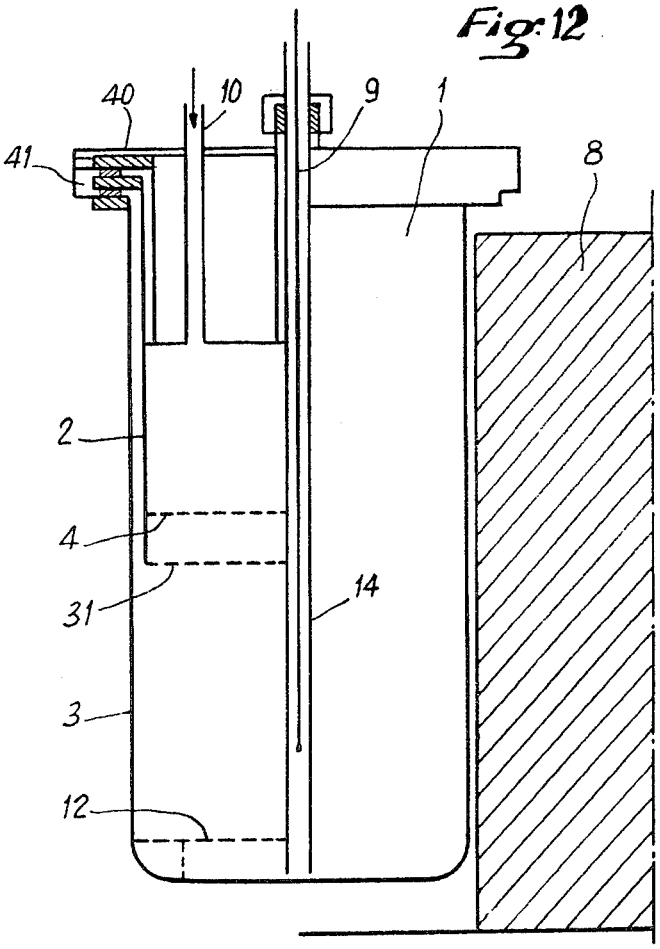
FIG. 12 is a sectional view, on a larger scale, of a variant of the reactor included in the plan of FIG. 1.

FIG. 12 shows a particularly simple embodiment of a reactor for carrying out the process of the invention. The lower part of the reactor constitutes the chamber 3 closed by a leaktight cover 40 having a watercooled gasket 41. The chamber 2 is constructed in the form of a container which can fit into the reactor before the cover 40 is placed in position. The bottom of the chamber 2 comprises the grid 4 for retaining the sand and allowing the activating gas to pass through, and a grid 31 for retaining the boron carbide, the latter preferably being pulverulent. A tube 10 fixed to the chamber 2 passes through the cover in order to bring $BF_3$ through the sand in the chamber 2. A central chimney 14 passes through the cover and also passes, in a leaktight manner, through the chamber 2 and terminates near the bottom of the reactor under a grid 12 for retaining the pieces to be boronised. The thermometric probe 9 can be arranged in the chimney 14.

We claim:

1. A carbon steel piece which has been subjected to a boronising treatment that effects a first very thin layer about 10 microns in thickness of non-oriented FeB and $Fe_2B$ crystals covering a second, thick layer of $Fe_2B$ crystals about 170 microns in thickness and having an acicular formation at the interface between said second layer and said carbon steel.

2. The steel piece as defined in claim 1 wherein the steel is tool steel.

Figure 5:
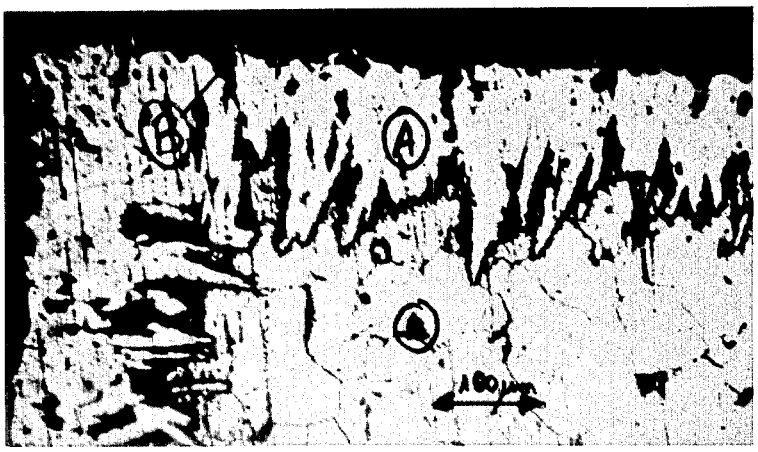
FIGS. 5 to 11 are micrograph sections of steels boronised by the process of the invention.
Figure 6:
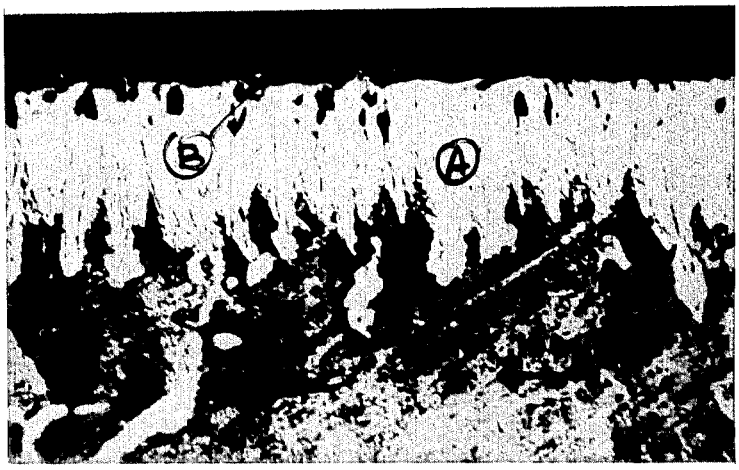

3. The carbon steel piece as claimed in claim 1 having a first layer of $FeB/Fe_2B$ and a second layer of $Fe_2B$ substantially as shown in FIG. 5.

* * * * *